US009936821B2

(12) United States Patent
D'Urso et al.

(10) Patent No.: US 9,936,821 B2
(45) Date of Patent: Apr. 10, 2018

(54) COLLAPSIBLE BREATHABLE MATTRESS

(71) Applicant: Baby Trend, Inc., Ontario (CA)

(72) Inventors: Stellario D'Urso, Chester, NJ (US); Hans H. Pompen, Redwood City, CA (US); Bradley James Mattarocci, Rancho Cucamonga, CA (US)

(73) Assignee: Baby Trend, Inc., Ontario, CA (US)

( * ) Notice: Subject to any disclaimer, the term of this patent is extended or adjusted under 35 U.S.C. 154(b) by 0 days.

(21) Appl. No.: 15/294,455

(22) Filed: Oct. 14, 2016

(65) Prior Publication Data

US 2017/0105548 A1 Apr. 20, 2017

Related U.S. Application Data

(60) Provisional application No. 62/241,573, filed on Oct. 14, 2015.

(51) Int. Cl.

| | |
|---|---|
| ***A47D 7/00*** | (2006.01) |
| ***A47D 15/00*** | (2006.01) |
| ***A47C 23/00*** | (2006.01) |
| ***A47C 23/24*** | (2006.01) |

(52) U.S. Cl.

CPC ..... *A47D 15/003* (2013.01); *A47C 23/005* (2013.01); *A47C 23/24* (2013.01)

(58) Field of Classification Search

CPC ..... A47D 7/00; A47D 7/01; A47D 13/00
USPC ..... 5/690, 722, 99.1, 655
See application file for complete search history.

(56) References Cited

U.S. PATENT DOCUMENTS

| | | | |
|---|---|---|---|
| 1,736,341 | A | 11/1929 | Fritz |
| 2,218,978 | A | 9/1938 | Akin |
| 2,287,907 | A | 6/1942 | Schettler |
| 2,459,445 | A | 1/1949 | Mcclintock |
| 2,607,930 | A | 8/1952 | Schettler |
| 2,692,993 | A | 11/1954 | Joseph |
| 2,695,415 | A | 11/1954 | Holton |
| 2,815,516 | A | 12/1957 | Holton |
| 2,924,832 | A | 2/1960 | Knowles |

(Continued)

FOREIGN PATENT DOCUMENTS

| | | | |
|---|---|---|---|
| CN | 204995054 | U | 1/2016 |
| CN | 204995061 | U | 1/2016 |

(Continued)

OTHER PUBLICATIONS

International Search Report and Written Opinion issued by the ISA/US, dated Mar. 31, 2017 for International Application No. PCT/IB16/01533; 9 pages.

*Primary Examiner* — Fredrick C Conley
(74) *Attorney, Agent, or Firm* — Faegre Baker Daniels LLP

(57) ABSTRACT

A support surface assembly comprising four corner elements; at least four elongated rigid frame sections; a first air permeable layer suspended between the at least four elongated rigid frame sections; and a second air permeable layer suspended between the at least four elongated rigid frame sections; wherein the four corner elements include at least one lock element, the lock element having a first position that engages at least one elongated frame section and prevents relative movement between the four elongated rigid frame sections; the lock element having a second position that permits relative movement between the four elongated rigid frame sections.

23 Claims, 12 Drawing Sheets

(56) References Cited

U.S. PATENT DOCUMENTS

| | | | | |
|---|---|---|---|---|
| 3,266,064 | A | 8/1966 | Murray | |
| 4,663,787 | A | 5/1987 | Koelsch | |
| 4,698,862 | A | 10/1987 | Mairs | |
| 4,730,356 | A | 3/1988 | Suzuki | |
| 5,016,301 | A | 5/1991 | Combs | |
| 5,212,841 | A | 5/1993 | Binnersley | |
| 5,303,438 | A | 4/1994 | Walker | |
| 5,351,348 | A | 10/1994 | Beger | |
| D353,494 | S | 12/1994 | Beger | |
| 5,423,099 | A | 6/1995 | Gulli | |
| 5,454,124 | A * | 10/1995 | Huang | A47D 13/063 5/98.1 |
| 5,463,785 | A | 11/1995 | Mckeel | |
| 5,490,292 | A | 2/1996 | Auburn | |
| 5,546,618 | A | 8/1996 | Beedy et al. | |
| 5,555,577 | A | 9/1996 | Volpe | |
| 5,561,876 | A * | 10/1996 | Petruzella | A47D 15/001 5/201 |
| 5,566,407 | A | 10/1996 | Lien | |
| 5,664,273 | A | 9/1997 | Obriot | |
| 5,675,852 | A | 10/1997 | Watkins | |
| 5,697,113 | A | 12/1997 | Shatz et al. | |
| 5,699,571 | A * | 12/1997 | Yowell | A47C 21/046 5/652.1 |
| 5,787,534 | A | 8/1998 | Hargest et al. | |
| 5,855,031 | A | 1/1999 | Swift | |
| 5,857,232 | A | 1/1999 | Mandavi | |
| 5,870,785 | A | 2/1999 | Hoorens | |
| 5,887,304 | A | 3/1999 | Von | |
| 6,026,525 | A | 2/2000 | Davis | |
| 6,055,690 | A | 5/2000 | Koenig | |
| 6,131,220 | A | 10/2000 | Morimura | |
| 6,182,315 | B1 | 2/2001 | Lee | |
| 6,336,237 | B1 | 1/2002 | Schmid | |
| 6,370,718 | B1 | 4/2002 | Schmid | |
| 6,425,152 | B1 | 7/2002 | Quarles | |
| 6,434,767 | B1 * | 8/2002 | Welsh, Jr. | A47D 7/04 5/93.2 |
| 6,438,775 | B1 | 8/2002 | Koenig | |
| 6,493,888 | B1 | 12/2002 | Salvatini et al. | |
| 6,684,437 | B2 | 2/2004 | Koenig | |
| 6,823,547 | B1 | 11/2004 | Harding et al. | |
| 6,854,143 | B2 | 2/2005 | Sharples | |
| 7,127,763 | B1 | 10/2006 | Schmid et al. | |
| 7,334,280 | B1 | 2/2008 | Swartzburg | |
| 7,404,219 | B2 | 7/2008 | Berkey | |
| 7,406,727 | B2 | 8/2008 | Wickstrom et al. | |
| 7,426,767 | B2 | 9/2008 | Mossbeck | |
| 7,614,098 | B1 * | 11/2009 | Quarry | A47C 7/407 24/13 |
| 7,681,260 | B2 | 3/2010 | Hallock et al. | |
| 8,065,767 | B2 | 11/2011 | Gabbai et al. | |
| 8,220,088 | B2 | 7/2012 | Waters et al. | |
| 8,261,381 | B2 | 9/2012 | Hallock et al. | |
| 8,407,834 | B1 | 4/2013 | Oh | |
| 8,434,179 | B2 | 5/2013 | Reeves et al. | |
| 8,539,628 | B2 | 9/2013 | Lee | |
| 8,590,075 | B1 | 11/2013 | Amjad et al. | |
| 8,607,390 | B2 | 12/2013 | Obriot et al. | |
| 8,621,687 | B2 | 1/2014 | Biykalski et al. | |
| 8,745,793 | B2 | 6/2014 | Bensoussan | |
| 8,769,746 | B2 | 7/2014 | Abadi | |
| 9,247,831 | B2 | 2/2016 | Miles et al. | |
| 2006/0207023 | A1 | 9/2006 | DeHart et al. | |
| 2007/0261173 | A1 | 11/2007 | Schlussel | |
| 2009/0217458 | A1 | 9/2009 | Lord | |
| 2013/0125304 | A1 | 5/2013 | DeHart | |
| 2013/0291311 | A1 | 11/2013 | Wang | |
| 2014/0033441 | A1 | 2/2014 | Morgan et al. | |

FOREIGN PATENT DOCUMENTS

| | | | |
|---|---|---|---|
| DE | 2448882 | A1 | 4/1976 |
| EP | 0852472 | B1 | 5/2003 |
| WO | WO9305685 | | 4/1993 |
| WO | WO 2006/048612 | A1 | 5/2006 |
| WO | WO 2007/031780 | A1 | 3/2007 |
| WO | WO 2011/035285 | A2 | 3/2011 |

* cited by examiner

COLLAPSIBLE BREATHABLE MATTRESS

PRIORITY

This application is a non-provisional filing that claims the priority of U.S. Provisional Application No. 62/241,573, the disclosure of which is hereby incorporated by reference.

TECHNICAL FIELD

The disclosed subject matter relates to a ventilated mattress especially for use in bedding for babies, toddlers and small children.

BACKGROUND

The sleeping needs of babies and toddlers are of concern for parents. Frequently, parents place their baby or toddler in enclosed bedding (e.g., a crib) in order to prevent their baby or toddler from falling from the bed. Traditional mattresses are difficult to clean and can allow undesired buildup of heat in or near the child.

Accordingly, it is desirable to provide a new ventilated mattress for babies and toddlers.

SUMMARY

The present disclosure includes a first embodiment including a support surface assembly comprising four corner elements; at least four elongated rigid frame sections; a first air permeable layer suspended between the at least four elongated rigid frame sections; and a second air permeable layer suspended between the at least four elongated rigid frame sections; wherein the four corner elements include at least one lock element, the lock element having a first position that engages at least one elongated frame section and prevents relative movement between the four elongated rigid frame sections; the lock element having a second position that permits relative movement between the four elongated rigid frame sections.

DETAILED DESCRIPTION

Figure 1A:
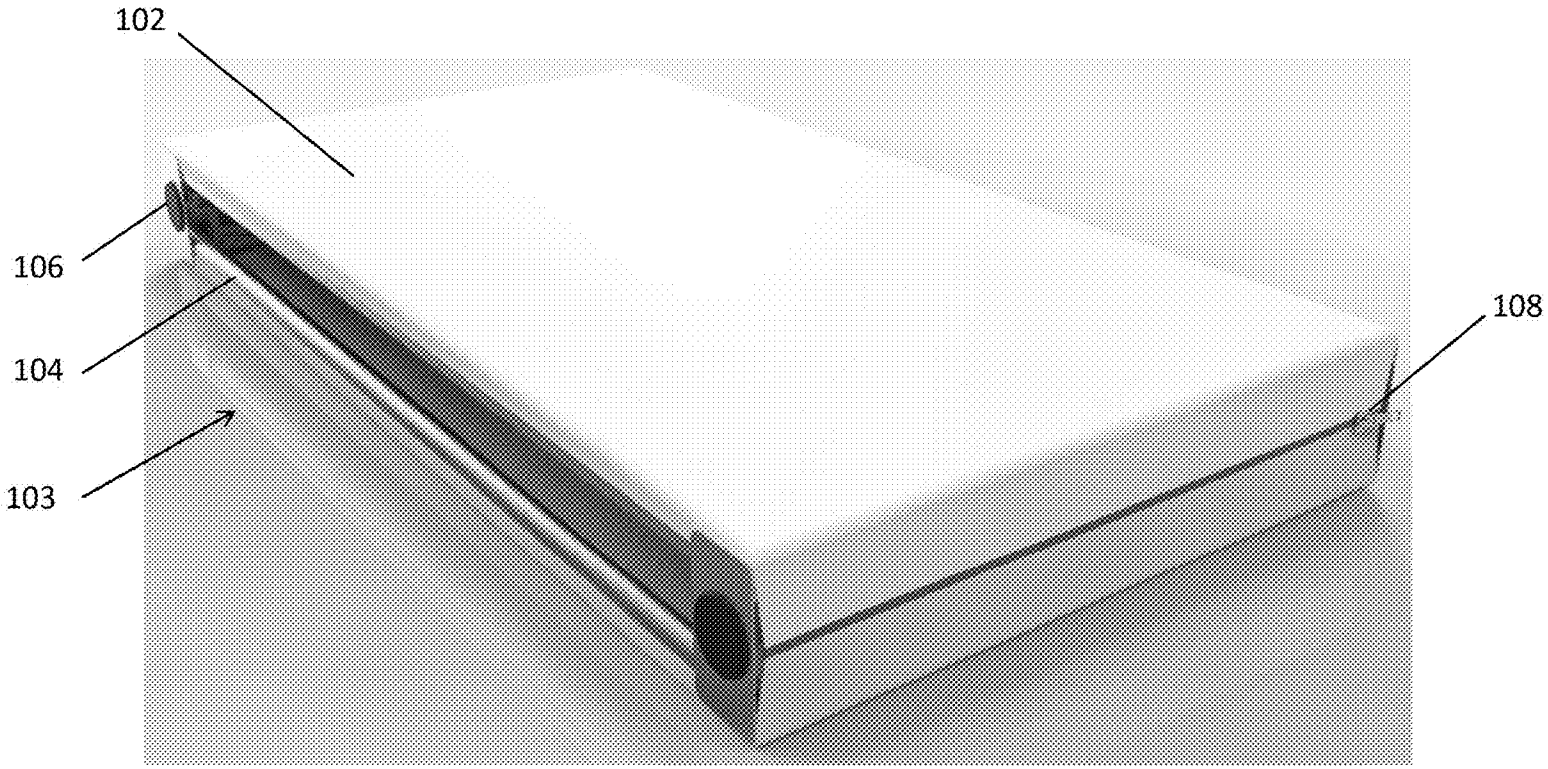
FIG. 1A is a perspective view of a first embodiment ventilated mattress.

In accordance with various embodiments of the disclosure, ventilated mattresses for children are provided.

Turning to FIGS. 1A, 1B, 1C, and 1D, an exemplary ventilated mattress 100 is shown. As illustrated, ventilated mattress 100 includes a cover 102, and a frame 103. The frame includes four frame bars 104, four hinge plates 106, two enclosure mechanisms 108, four tracks 110, eight folding arms 112, four hinges 114, and two hinges 116.

Figure 1B:
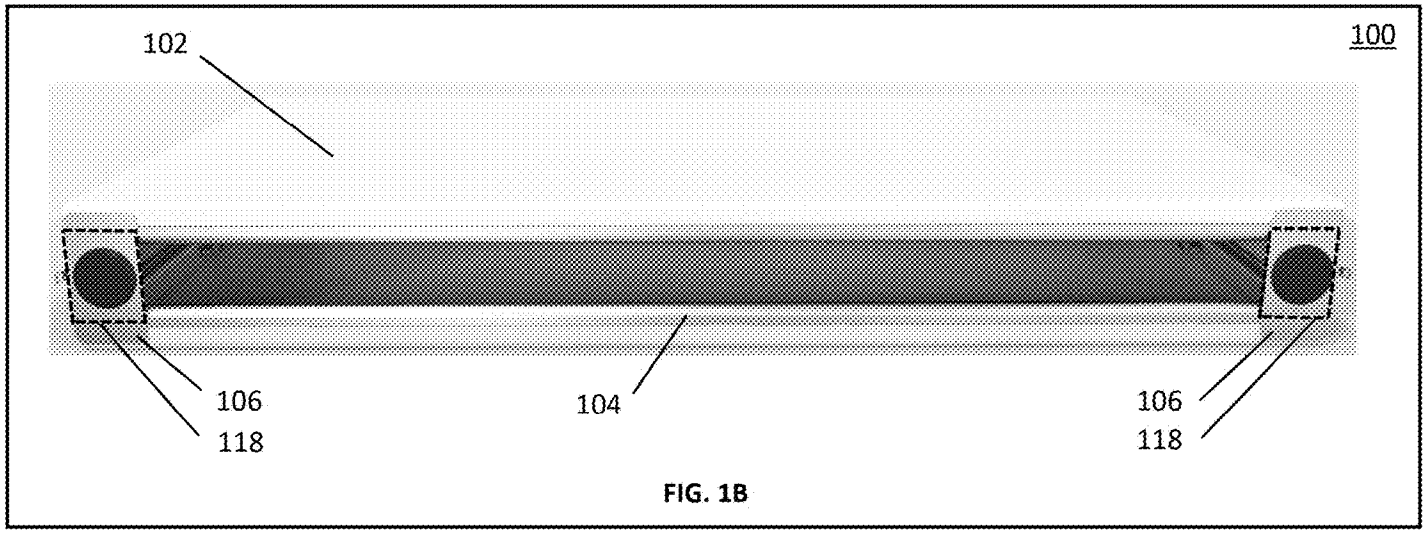
FIG. 1B is a side perspective view of the mattress of FIG. 1A.
Figure 1C:
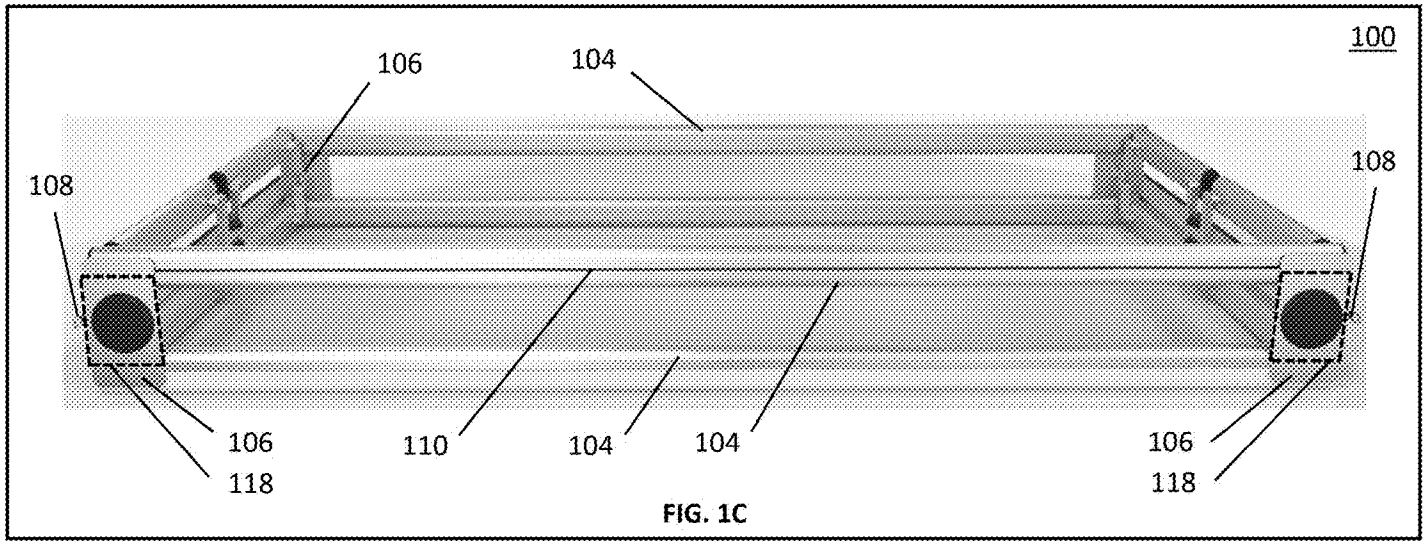
FIG. 1C is a side perspective view of the mattress of FIG. 1B with the upper support surface removed.
Figure 1D:
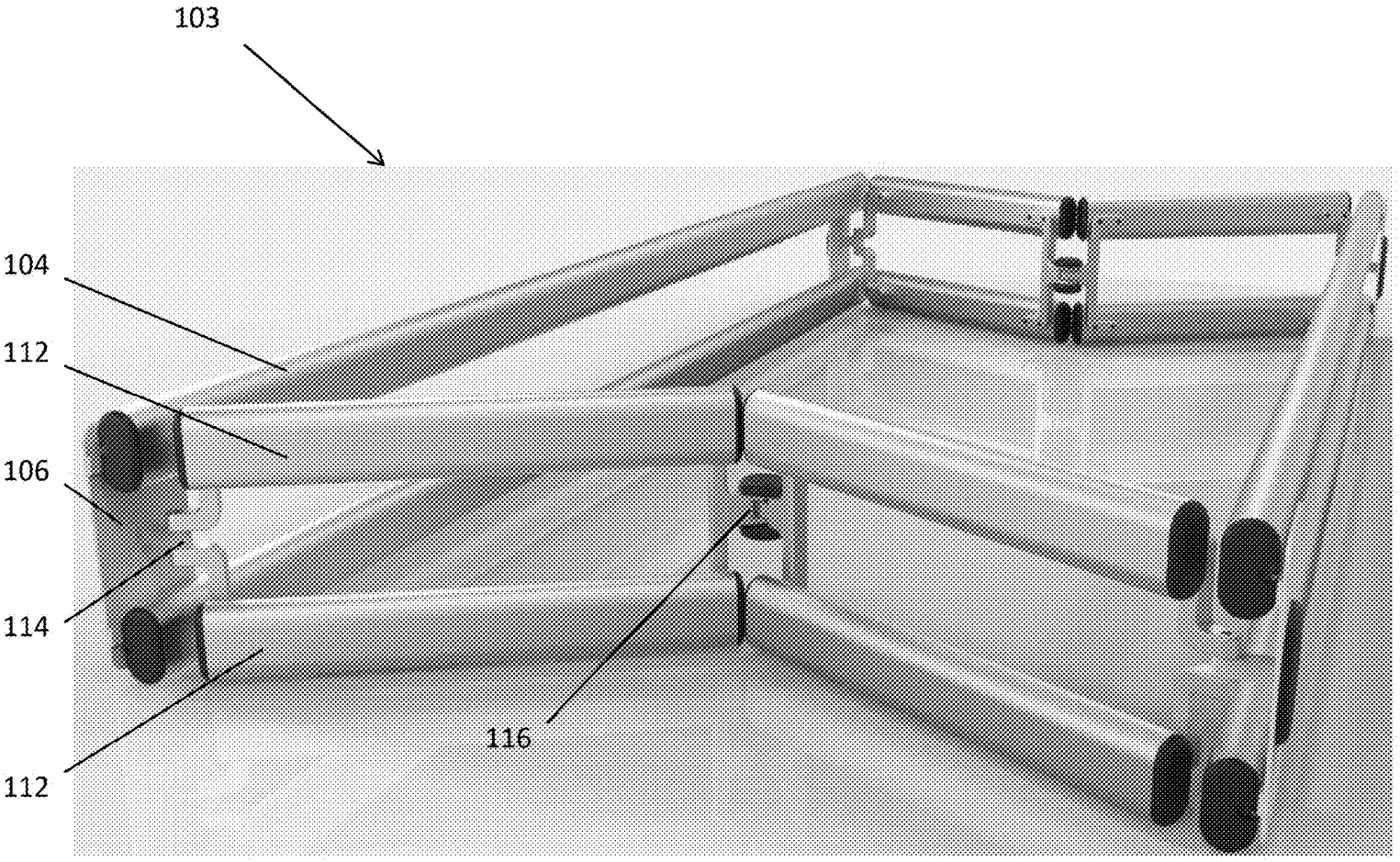
FIG. 1D is a perspective view of the support frame of the mattress of FIG. 1A, with the frame in a partially-collapsed orientation.

Ventilated mattress 100 is configured to have an expanded position and a collapsed position. For example, as illustrated in FIGS. 1A and 1B, ventilated mattress 100 has an expanded position configured to form a flat or substantially flat surface suitable for supporting a child during sleep. As another example ventilated mattress 100 has a collapsed position configured to reduce the effective size of ventilated mattress 100. Fig. FIG. 1D, shows mattress 100 in a partially collapsed position. As a more particular example, ventilated mattress 100, and specifically frame 103 can collapse more fully into a more compact size and shape suitable for transportation and/or storage.

In some embodiments, ventilated mattress 100 can be configured to have any suitable dimensions when in an expanded position. For example, ventilated mattress 100 can be configured to have dimensions matching regulated standards for crib mattresses. As a more particular example, ventilated mattress 100 can have a sleeping surface that is 27.5 inches wide and 51.5 inches long, and have a depth that is less than or equal to 6 inches.

In some embodiments, cover 102 includes any suitable air permeable material or materials. For example, cover 102 illustratively includes one or more of a mesh material, a plastic, a fabric, and/or any other suitable air permeable material. As a more particular example, cover 102 includes a washable, air permeable mesh material, such as a plastic mesh, a fiber mesh, a composite mesh, any suitable washable, air permeable mesh material, and/or any combination thereof. As a still more particular example, cover 102 can be made from the Extinct-Spacer mesh material supplied by Cosmo Hong Kong Limited, Zhongshan City, Guangdong, China.

In some embodiments, cover 102 can include a hypoallergenic material. For example, cover 102 can include a polyester fiber material, silk, cotton, any other suitable hypoallergenic material, and/or any suitable combination thereof.

Enclosure mechanism 108 can be any suitable enclosure mechanism. For example, enclosure mechanism 108 can be a clasp locker, zip fastener, a button, a series of buttons, any other suitable enclosure mechanism, and/or any suitable combination thereof.

In some embodiments, enclosure mechanism 108 and cover 102 are configured such that cover 102 forms two suitable sleeping surfaces when attached to itself via enclosure mechanism 108 and positioned over frame bars 104 and folding arms 112.

In some embodiments, cover 102 is configured such that, when ventilated mattress 100 is in an expanded position, cover 102 has a relatively firm sleeping surface on one side of ventilated mattress 100 and a relatively soft sleeping surface on another side of ventilated mattress 100. For example, cover 102 can include different materials having different hardness and/or elastic properties. In such an example, a length of cover 102 can be made of a relatively soft and/or relatively elastic material while another length of cover 102 can be made of a relatively firm and/or relatively inelastic material. As a more particular example, a length of cover 102 can be made of a relatively elastic polyurethane while another length of cover 102 can be made of a relatively inelastic nylon. As another example, cover 102 can have a length that is configured to be relatively inelastic and a length that is configured to be relatively elastic by applying a different degree of tension to each length when ventilated mattress 100 is in an expanded position. As a more particular example, cover 102 can be configured such that, when in an expanded position, frame bars 104 apply relatively little tension to the relatively elastic length of cover 102 while frame bars 104 apply relatively more tension to the relatively inelastic length of cover 102.

In some embodiments, frame bar 104, hinge plate 106, and folding arm 112 can include any suitable structural material. For example, frame bar 104, hinge plate 106, and folding arm 112 can include a relatively rigid structural material such as plastic, aluminum, graphite, any other suitable relatively rigid structural material, and/or any combination thereof.

In some embodiments, frame bar 104 and folding arm 112 can have any suitable shape. In one example, frame bar 104 and/or folding arm 112 has a shape configured to minimize contact with the portion of cover 102 that is provides the sleeping support surface. As a more particular example, frame bars 104 and/or folding arms 112 can have an oval shape, an oblong shape, a semicircular shape, any other suitable shape, and/or any suitable combination thereof.

In some embodiments, a hinge plate 106 is attached to two frame bars 104 and to two folding arms 112 via a hinge 114 in any configuration suitable to create a collapsible mattress frame. For example, a hinge plate 106 can be attached at or near the ends of frame bars 104, and configured to hold frame bars 104 parallel or substantially parallel. To continue the example, hinge plates 106 can be attached to folding arms 112 via hinges 114 such that a user can cause folding arms 112 to collapse inward relative to the mattress frame.

In some embodiments, hinge plates 106 are attached to frame bars 104 via track 110. For example, hinge plate 106 can include a protrusion configured to fit within a cavity of track 110. In such an example, the protrusion can have any shape suitable for fitting within track 110. As a more particular example, hinge plate 106 can include a circular, semicircular, or ovular protrusion configured to fit inside a circular, semicircular, or ovular shape of the cavity of track 110. As another more particular example, hinge plate 106 can include a substantially triangular protrusion configured to fit inside a substantially triangular cavity of track 110.

In some embodiments, hinge plate 106 and track 110 can be configured to allow a user to slide hinge plate 106 along track 110 and to cause hinge plate 106 to snap and/or lock into place at or near the end of frame bars 104. For example, track 110 can include a snapping mechanism configured to protrude into a cavity of track 110 and snap into place when hinge plate 106 is moved to a position at or near the ends of frame bars 104. As another example, track 110 can be configured to include a protrusion into the cavity in order to prevent hinge plate 106 from sliding too far toward the center of frame bars 104. In such an example, cover 102, enclosure mechanism 108, track 110 and hinge plate 106 can be configured to allow a user to slide hinge plate 106 into track 110 and secure hinge plate 106 in place by using enclosure mechanism 108 to fasten cover 102 to itself, thereby applying a pressure appropriate to hold hinge plate 106 in place.

In some embodiments, hinge plate 106, track 110, and cover 102 can be configured to allow a user to slide hinge plate 106 along track 110 and to cause hinge plate 110 to snap and/or lock into place at or near the end of frame bars 104 while cover 102 is in place such that upon hinge plate 106 snapping and/or locking into place, ventilated mattress 100 is in a configuration appropriate for sleeping (i.e., an expanded position), as illustrated in FIGS. 1A and 1*n* FIG. 1B. For example, hinge plate 106 can attach to track 110 while allowing a clearance sufficient to allow hinge plate 106 to slide on track 110 even when cover 102 is located between hinge plate 106 and frame bar 104. In some embodiments, hinge plate 106 can be immovably attached to track 110, such as by welding, gluing, riveting, soldering, any other suitable method of immovable attachment, and/or any combination thereof.

In some embodiments, hinge plate 106, track 110, and cover 102 are configured to allow a user to slide cover 102 in place along track 110. For example, cover 102 can include protrusions at its edges configured to slide within track 110 such that upon a user moving ventilated mattress 100 into an expanded position, track 110 creates tension in cover 102 via the protrusions in order to form an appropriate sleeping surface on cover 102.

In some embodiments, hinge plate 106, track 110, and cover 102 can be configured to allow a user to slide cover 102 in place along track 110 when hinge plates 106 are in a fixed position. For example, two or more of hinge plates 106 can be attached to frame bars 104 without the use of track 110 (e.g., via an immovable attachment method, as described above), and can have a size and a shape that allows the full length of track 110 to be open and/or exposed, thereby allowing a user to slide cover 102 in place along track 110 even when hinge plate 106 is in place. As a more particular example, as shown in FIGS. 1B and 1C, hinge plate 106 can have a size and shape that is substantially similar to outline 118, which does not extend past track 110.

In some embodiments, cover 102 and folding arms 112 can be configured to attach in order to apply tension to cover 102 when ventilated mattress 100 is in an expanded position. For example, cover 102 can and folding arms 112 can include a fastening mechanism, such as a button, clip, snap, any other suitable fastening mechanism, and/or any combination thereof.

In some embodiments, folding arms 112 and hinges 116 can be configured to allow a user to collapse folding arms 112 completely such that each pair of folding arms that are attached by a hinge 114 can be folded far enough to make flush or substantially flush contact upon each other. For example, as illustrated in FIG. 1D, hinge 116 can protrude inward relative to the mattress frame and connect four folding arms 112 with a clearance between folding arms 112 that can allow the folding arms to be rotated about hinge 116 by ninety degrees without the ends of folding arms 112 making contact with each other.

In some embodiments, hinge 114 and hinge 116 can be configured to lock and/or unlock by including a button, switch, and/or any other suitable mechanism for locking and/or unlocking. For example, hinge 116 can include a button such that, if ventilated mattress 100 is locked into an expanded position, a user pressing the button can cause hinge 116 to unlock and allow movement of folding arms 112, such that ventilated mattress 100 can enter a collapsed position.

In some embodiments, cover 102, frame bars 104, and hinge plates 106 can be configured such that, when ventilated mattress 100 is in an expanded position, ventilated mattress 100 has a hollow area with ventilation openings formed by a space between frame bars 104 and cover plates 106, the openings appropriate for allowing air to flow through the mattress, as shown in FIGS. 1A, 1B and 1C.

Figure 2:
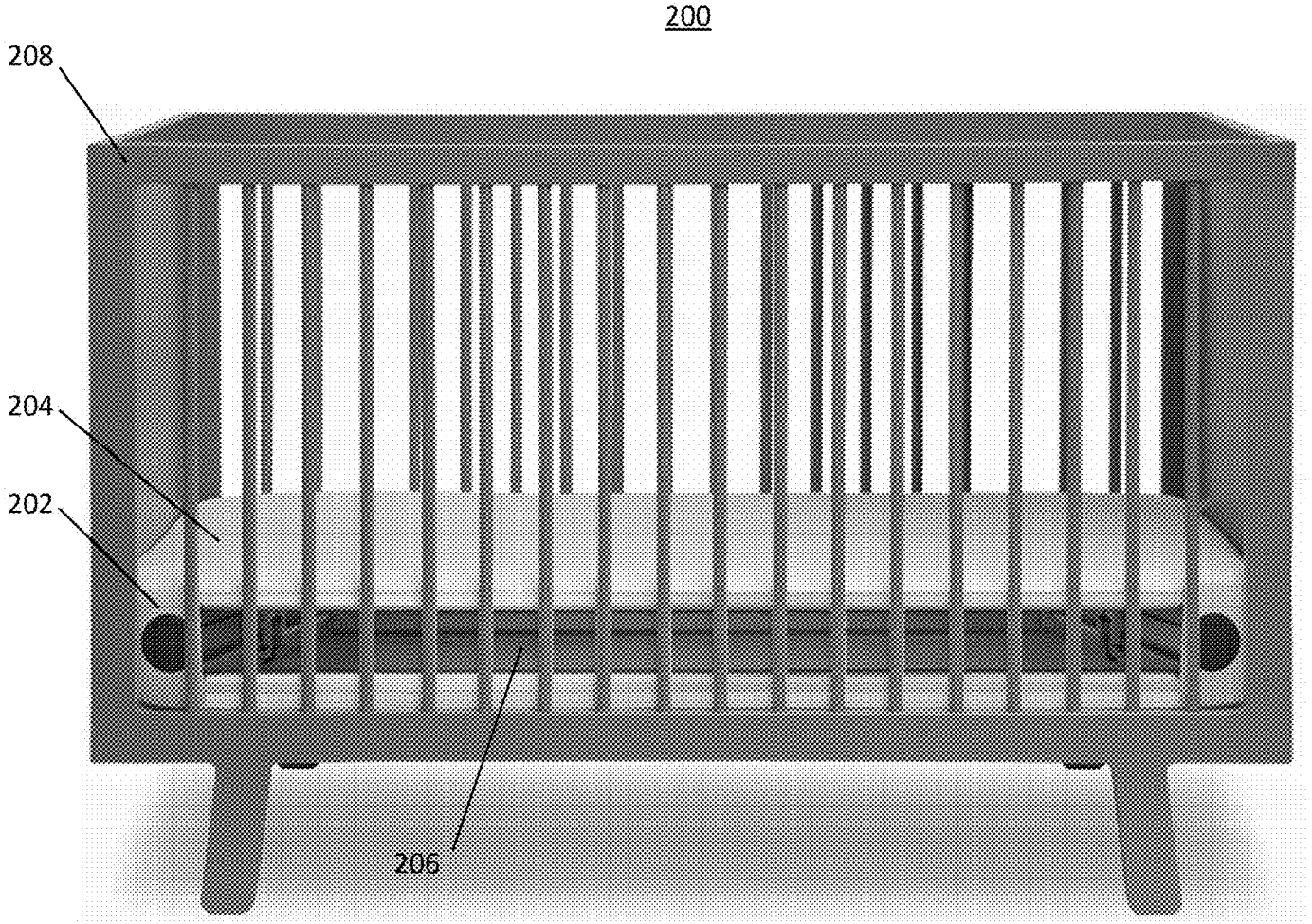
FIG. 2 is a side perspective view of the mattress of FIG. 1A placed in a crib.

Turning to FIG. 2, an example 200 of a ventilated mattress placed in a crib assembly is shown in accordance with some embodiments of the disclosed subject matter. As illustrated, ventilated mattress 202 can be placed inside a crib assembly 208 in some embodiments, and can include a sleeping surface 204 and a ventilation opening 206 in some embodiments.

In some embodiments, ventilated mattress 202 can be any suitable ventilated mattress, such as ventilated mattress 100, as described above in connection with FIGS. 1A, 1B, 1C, and 1D.

In some embodiments, ventilation opening 206 and crib structure 208 can be configured to allow air to flow through ventilation opening 206. For example, as illustrated in FIG. 2, crib structure 208 can have vertical bars that extend across ventilation opening 206 but do not prevent air from flowing through ventilation opening 206.

In some embodiments, at least some of the above described parts of the ventilated mattress of FIGS. 1A, 1B, 1C, 1D, and 2 can be omitted.

In some embodiments of the disclosed subject matter, the ventilated mattress described herein can include a collapsible frame and a cover. The cover can, for example, be made from a washable, hypoallergenic, and/or air permeable material or materials. The cover can be attached to the frame such that when the frame is in an expanded position the cover is drawn tight and forms a sleeping surface. This configuration can form a hollow area beneath the sleeping surface such that air can pass through the ventilated mattress, thereby preventing the buildup of gases within the ventilated mattress.

In some embodiments, the ventilated mattress described herein can be configured to be reversible such as to have a firm sleeping surface that is relatively firm and to have a soft sleeping surface that is relatively soft.

In some embodiments, the ventilated mattress described herein can include a frame that is configured to collapse and/or fold such as to facilitate transportation and/or storage. The frame can include joints configured to lock in place when the frame is in a collapsed position and/or in an expanded position.

In some embodiments, the ventilated mattress described herein can include a sleep computer module that is configured to monitor information about a child user and provide the information to a guardian of the child user. For example, a sleep computer module can be located within in the hollow area of the mattress and include a thermal night vision camera to detect the movement, position, and temperature of a child sleeping on the mattress. As another example, a sleep computer module can provide soothing noises to assist a child in falling asleep.

Figure 3:
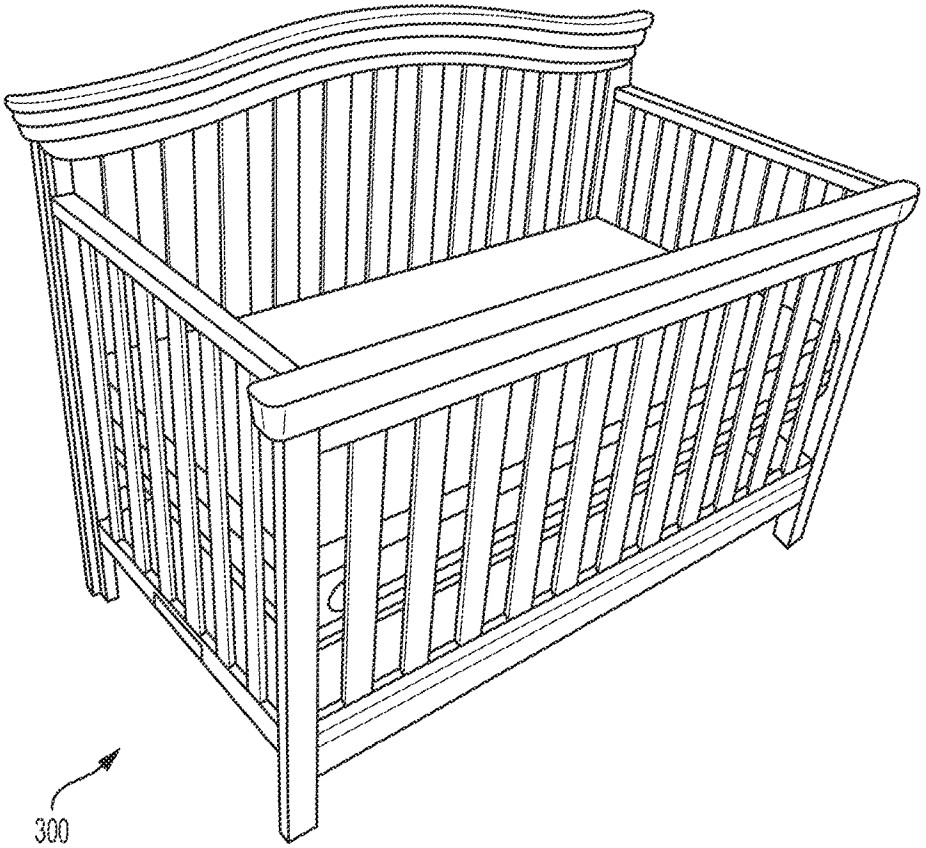
FIG. 3 is perspective view of a second embodiment mattress.
Figure 4:
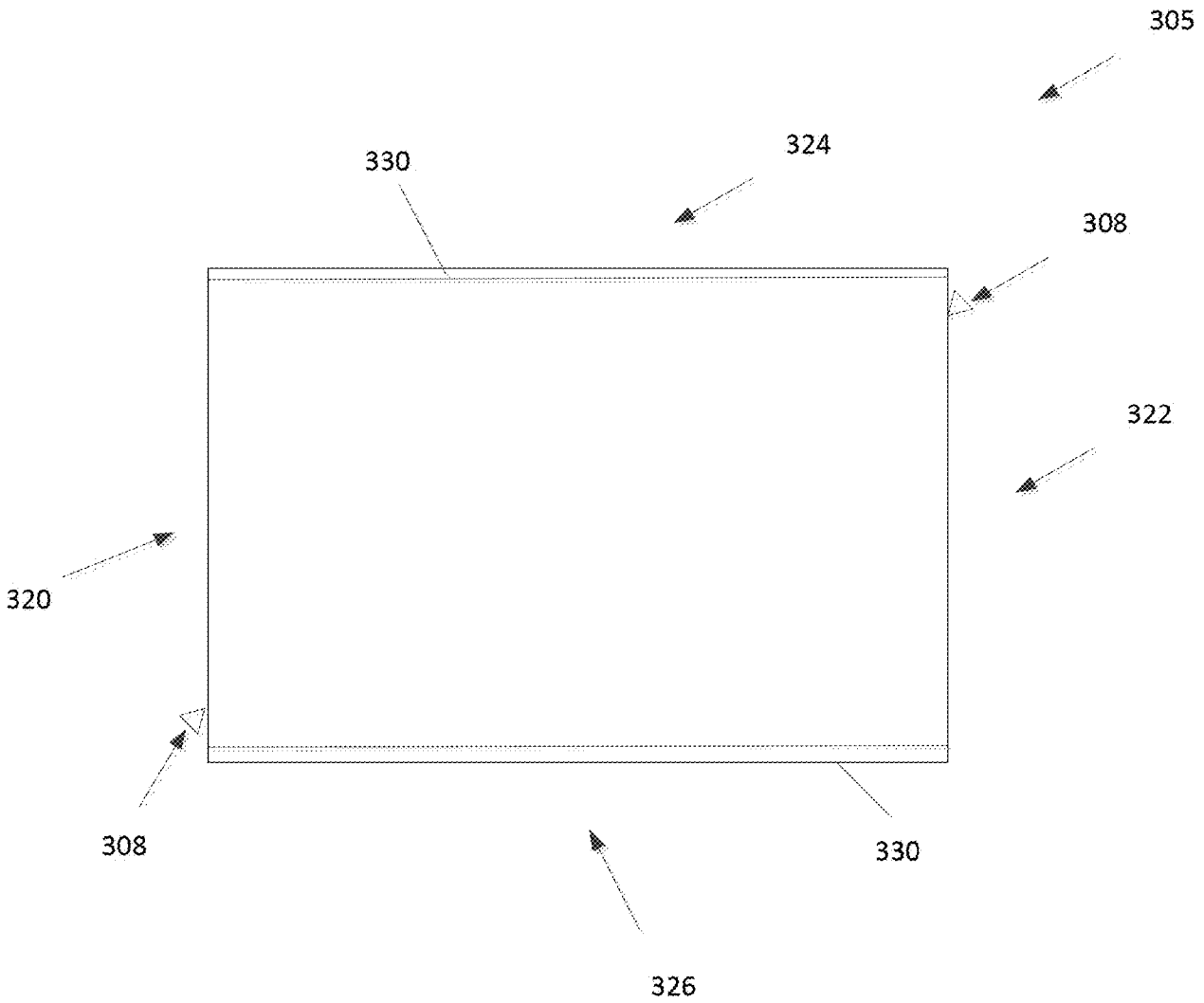
FIG. 4 is a top plan view of a cover of the mattress of FIG. 3.

FIG. 3 shows another embodiment mattress 300. Mattress 300 includes cover 302 and frame 304. Cover 302 is similar to cover 102. Cover 302 includes two sides, upper side 305, FIG. 4, and lower side 307. It should be appreciated that mattress 300 is reversible such that either side 305, 307 can be vertically higher than the other in use. Sides 305, 307 are constructed from fabric had have enclosure mechanisms 308 coupled to opposing ends 320, 322. Ends 324, 326 of sides 305, 307 include sleeves 330 or other thickness elements that run substantially the length of ends 324, 326. In use, sleeves 330 are slid into tracks 310. The width of sleeves 330 (or diameter of sleeves 330, if round) is greater than the width of an opening 332 of tracks 310 such that once slid into tracks 310 from a longitudinal end thereof, sleeves 330 are unable to exit tracks 310 by passing through the opening 332. As such, the cover 302 is coupled to the frame along the substantially full length of the mattress 300.

Figure 5:
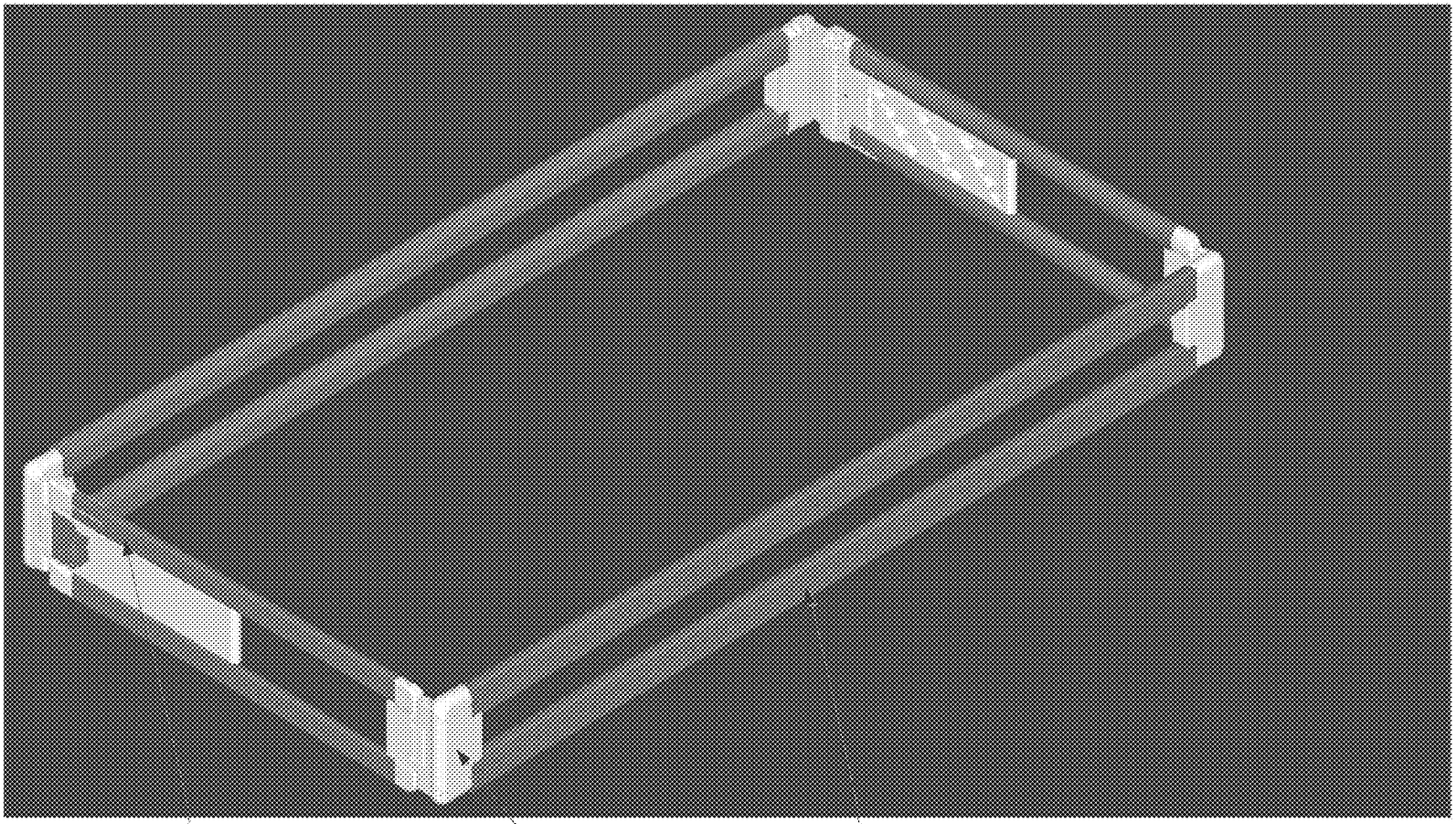
FIG. 5 is a perspective view of an expanded frame of the mattress of FIG. 3.

Frame 304, FIG. 5, includes longitudinal bars 350, width bars 352, first hinges 354, and second hinge mechanisms 356. Longitudinal bars 350 are illustratively longer than width bars 352, but this need not be the case. Longitudinal bars 350 and width bars 352 illustratively have a common cross-sectional shape, but again, this need not be the case.

Longitudinal bars 350 (and width bars 352) have rounded corners 358 and have tracks 310 defined along their length. Width bars 352 further include hinge holes 360 defined therein. Each side of frame 304 includes an upper and a lower bar (350, 352). Hinge holes 360 are located on the side of upper and lower width bars 352 that faces the other (upper or lower) width bar 352 on the same end of mattress 300. Bars 350, 352 are generally hollow and receive portions of hinges 354, 356 therein for coupling thereto. Longitudinal bars 350 are illustratively fixed to hinges 354, 356 via a rivet or other fastener that passes through bars 350 and through a portion of hinges 354, 356. Width bars are likewise coupled between hinges 354, 356 via a rivet or other fastener that passes through bars 350 and through a portion of hinges 354, 356.

Figure 6:
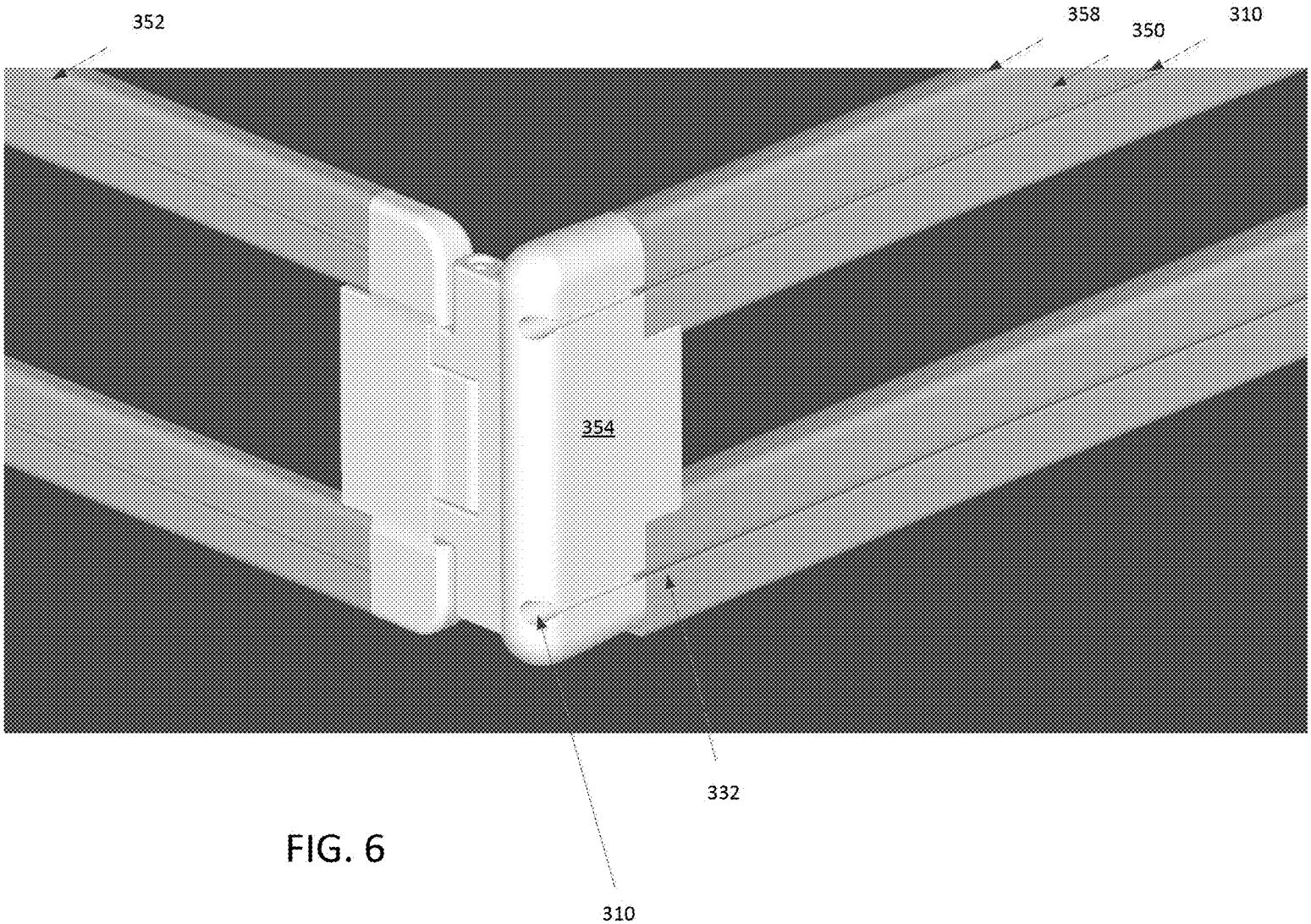
FIG. 6 is a perspective view of a hinge of the frame of FIG. 5.
Figure 7:
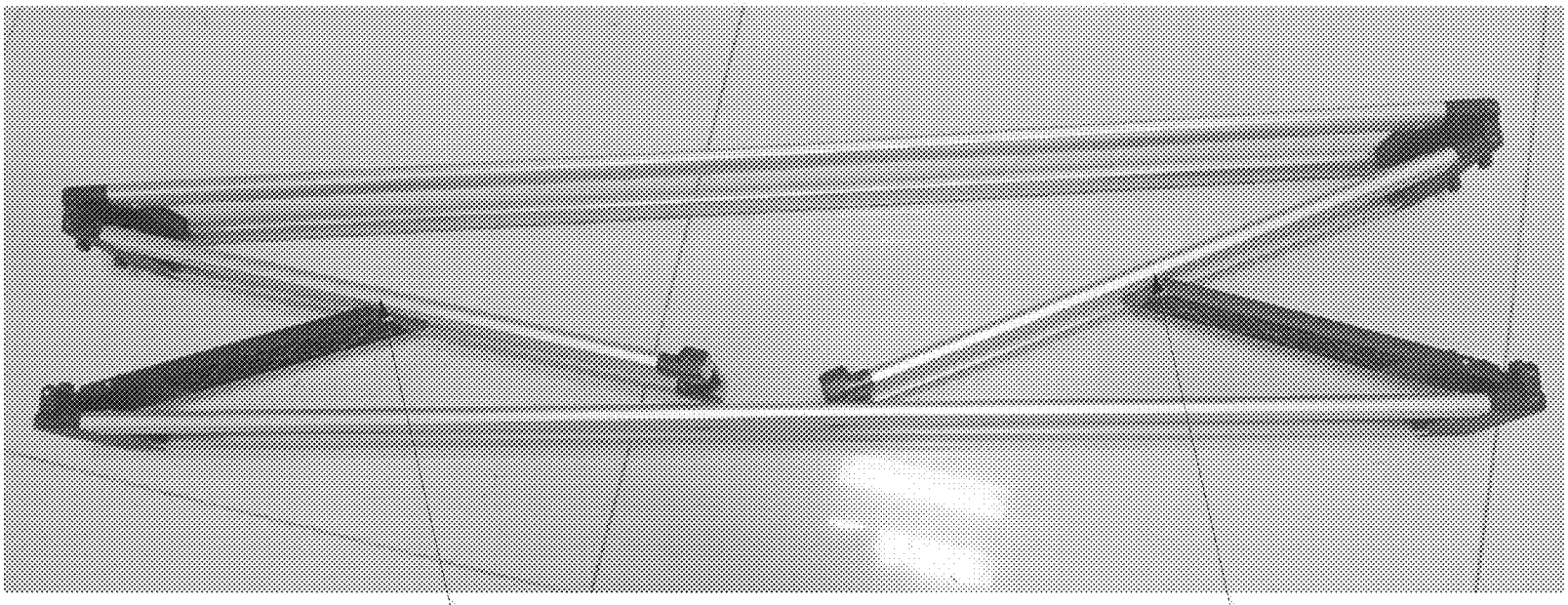
FIG. 7 is top perspective view of the frame of FIG. 5 in a partially collapsed state.
Figure 8:
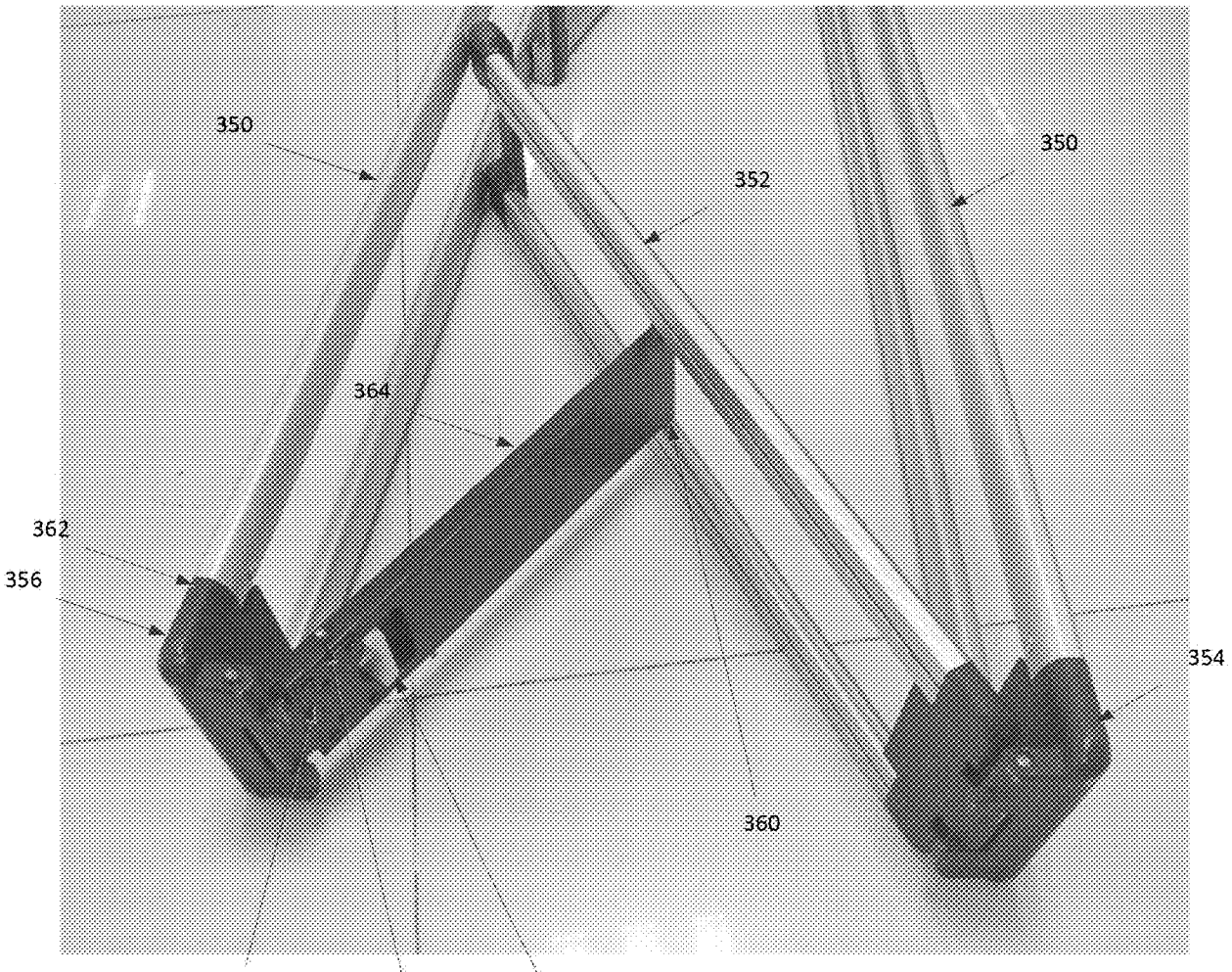
FIG. 8 is a side perspective view of an end of the frame of FIG. 7 in the partially collapsed state.
Figure 9:
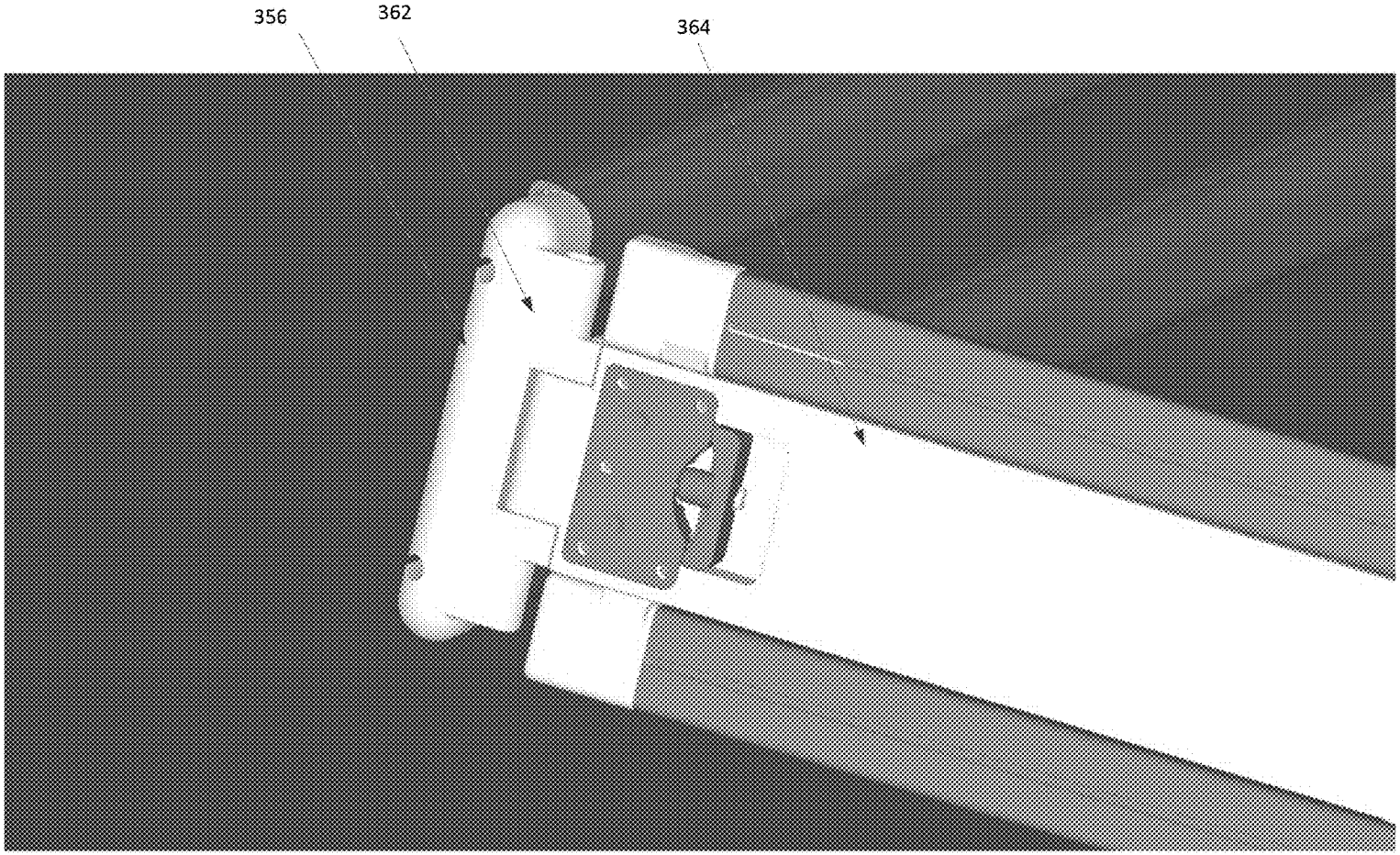
FIG. 9 is a perspective view of a lock hinge of the frame of FIG. 5.
Figure 10:
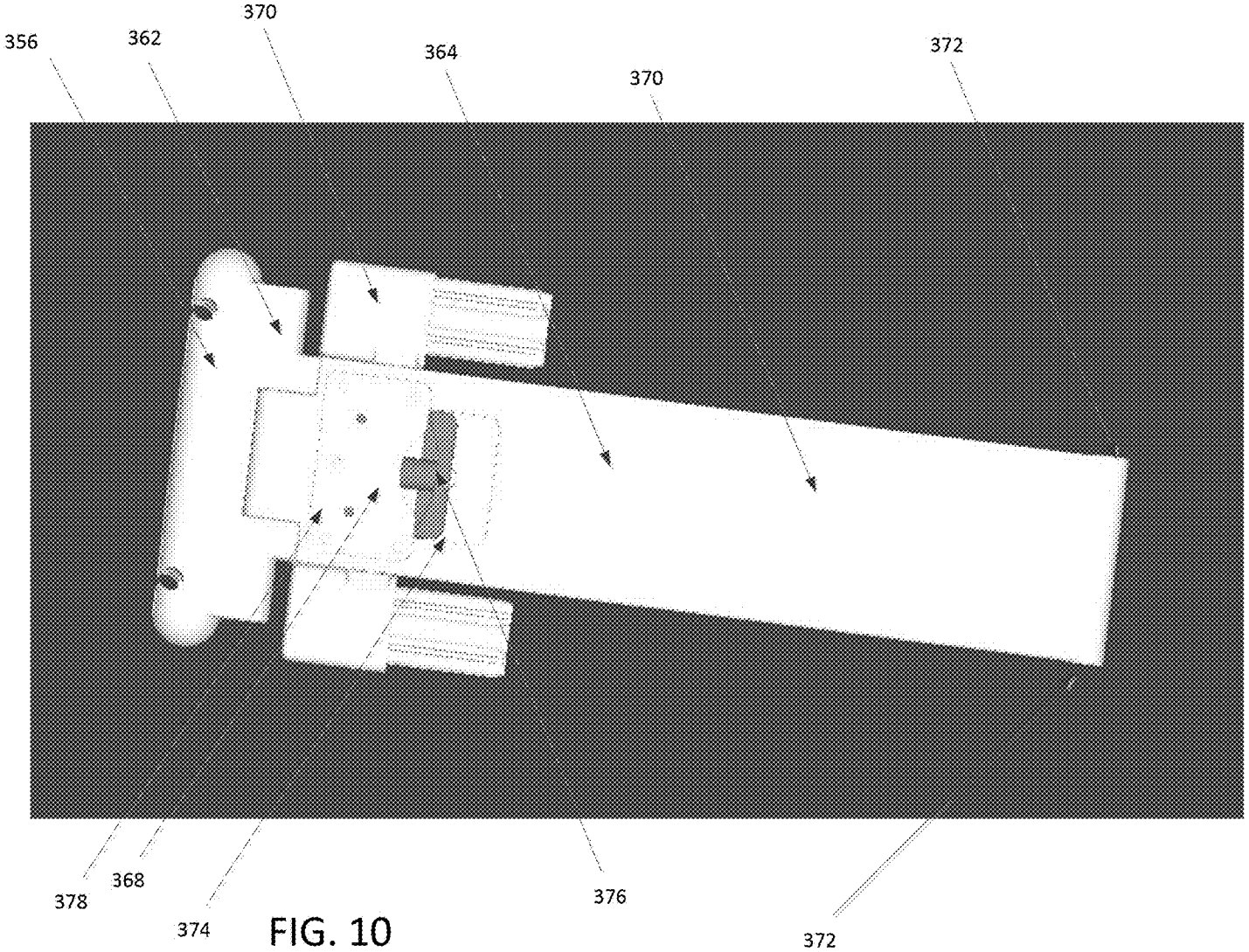
FIG. 10 is another perspective view of the hinge of FIG. 9.

Two first hinges 354 are located on a common lateral side of mattress 300. Two second hinge mechanisms 356 are located on a common lateral side of mattress 300 that is opposite the side having first hinges 356. First hinges 354 are free hinges that do not lock and have approximately 90 degrees of travel. FIG. 6 shows first hinges 354 in the open and expanded position. FIGS. 7 & 8 show first hinges 354 in a partially closed and collapsed position.

Second hinge mechanisms 356 include a fixed hinge member 362 and a pivoting lock member 364. Fixed hinge member 362 and pivoting lock member 364 are joined by a hinge rod to allow hinged movement therebetween. Fixed hinge member 362 is fixed to longitudinal bars 350.

Pivoting lock member 364 includes lock housing 366, lock 368, and detent receiver 370. Lock housing 366 is a generally rectangular element that is sized to fit between width bars 352 when frame 304 is in an expanded position. One end of lock housing 366 includes hinge detents 372. In assembly, hinge detents are received in hinge holes 360 defined in width bars 352 and provide for hinged movement of pivoting lock member 364 relative to width bars 352. Lock housing 366 also includes a lock aperture 374. Lock aperture 374 receives lock 368 therein.

Lock 368 includes release 376, mechanism 378, and detents 380. Lock 368, via mechanism 378 is biased to a locked position in which detents 380 extend out of lock housing 366. Detent receiver is illustratively a plastic piece that is mounted in an end of width bars 352.

A user can pull on release 376 which causes detents 380 to retract into lock housing 366. When frame 304 is in the expanded position, detents 380 that extend out of lock housing 366 engage detent receiver 370. Detents 380 are biased to the position that extends out of lock housing 366. When detents 380 are within detent receiver 370, the detents 380 along with detents 372 provide points of contact that fix the orientation of bars 350, 352 and hold frame 304 in the expanded position. When the release 376 is pulled such that detents 380 are retracted, detent receiver 370 is free to disengage from lock housing 366 to allow frame 304 to assume a collapsed position, FIG. 7.

It should be appreciated that both first hinges 354 and second hinge mechanisms 356 include a continuation of tracks 310 of longitudinal bars 350 such that the tracks 310 extend to an end of the frame 304 and present an open end able to receive sleeves 330.

When frame 304 is in the expanded orientation, FIG. 5, cover 302 is mounted thereto by sliding respective sleeves 330 into respective tracks 310. The exact sizings of cover sides 305, 307 are chosen to provide a desired firmness for that side of mattress 300. Once both sides 305, 307 are mounted, they are coupled together via enclosure mechanisms 308. The mattress 300 is then placed within a crib or otherwise positioned as desired.

When disassembly is desired, a reverse operation is performed. It should be appreciated that disassembly can be partial, where only the cover 302 is removed (such as to be laundered) or where cover 302 remains and frame 304 is collapsed. Cover removal is achieved by disengaging one or more enclosure mechanisms 308 and then sliding cover 302 off until sleeves 330 fully disengage tracks 310.

Collapse of frame 304 with the cover 302 still thereon is achieved in the same manner as when the cover 302 is off. Lock 368 is positioned in second hinge mechanisms 356 such that it accessible and operable by a user with the cover 302 thereon.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

The invention claimed is:

1. A support surface assembly comprising:

four corner elements;

at least four elongated rigid frame sections;

a first air permeable layer suspended between the at least four elongated rigid frame sections and defining an upper side of the support surface assembly for supporting a child when the support surface assembly is in a first orientation; and a second air permeable layer suspended between the at least four elongated rigid frame sections in spaced apart relationship from the first air permeable layer and defining a lower side of the support surface assembly for supporting a child when the support surface assembly is in a second orientation, the lower side facing opposite the upper side;

wherein the four corner elements include at least one lock element, the lock element having a first position that engages at least one elongated frame section and prevents relative movement between the four elongated rigid frame sections; the lock element having a second position that permits relative movement between the four elongated rigid frame sections.

2. The support surface assembly of claim 1, wherein the first air permeable layer has a first stiffness and the second air permeable layer has a second stiffness.

3. The support surface assembly of claim 1, further including an inner space defined by the elongated rigid frame sections and located between the first air permeable layer and second air permeable layer, the inner space being devoid of material that provides support to either of the first or second air permeable layers.

4. A ventilated mattress, comprising:

a frame, comprising a first frame bar having a first end coupled to a first hinge plate, a second end coupled to a second hinge plate, and a rigid body extending from the first ends to the second end, a second frame bar having a first end coupled to a third hinge plate, a second end coupled to a fourth hinge plate, and a rigid body extending from the first end to the second end, a first folding arm having a first end coupled to a first hinge connected to the first hinge plate and a second end coupled to a first folding arm hinge, a second folding arm having a first end coupled to a second hinge connected to the third hinge plate and a second end coupled to the first folding arm hinge; and a cover formed of air permeable material and configured to fit over the frame;

wherein the first hinge, the second hinge and the first folding arm hinge permit the first folding arm and the second folding arm to pivot from an expanded position toward a center of the frame into a collapsed position.

5. The ventilated mattress of claim 4, wherein the frame further comprises:

a third folding arm having a first end coupled to a third hinge connected to the second hinge plate and a second end coupled to a second folding arm hinge; and a fourth folding arm having a first end coupled to a fourth hinge connected to the fourth hinge plate and a second end coupled to the second folding arm hinge;

wherein the third hinge, the fourth hinge and the second folding arm hinge permit the third folding arm and the fourth folding arm to pivot from an expanded position toward the center of the frame into a collapsed position.

6. The ventilated mattress of claim 4, wherein the first folding arm and the second folding arm are substantially axially aligned when in the expanded position and are substantially parallel to each other when in the collapsed position.

7. The ventilated mattress of claim 4, wherein the cover includes a first layer and a second layer connected to the first layer by an enclosure mechanism.

8. The ventilated mattress of claim 7, wherein the first layer forms a first sleeping surface and the second layer forms a second sleeping surface, the first sleeping surface having a firmness that is greater than a firmness of the second sleeping surface.

9. The ventilated mattress of claim 7, wherein the first layer has an elasticity that is greater than an elasticity of the second layer.

10. The ventilated mattress of claim 4, wherein the frame further comprises a third frame bar coupled between the first hinge plate and the second hinge plate in parallel relationship with the first frame bar, the first frame bar and the third frame bar defining a first ventilation opening along a length of the mattress to permit air to flow through the mattress.

11. The ventilated mattress of claim 10, wherein the frame further comprises a fourth frame bar coupled between the third hinge plate and the fourth hinge plate in parallel relationship with the second frame bar, the second frame bar and the fourth frame bar defining a second ventilation opening along the length of the mattress to permit air to flow through the mattress.

12. The ventilated mattress of claim 4, wherein the first hinge plate comprises a protrusion and the first end of the first frame bar comprises a track sized to receive the protrusion to couple the first frame bar to the first hinge plate.

13. The ventilated mattress of claim 12, wherein the cover includes a protrusion along an edge of the cover, the cover protrusion being configured to slide within the track of the first frame bar to attach the cover to the first frame bar.

14. The ventilated mattress of claim 4, wherein the first folding arm contacts the second folding arm when the folding arms are in the collapsed position.

15. The ventilated mattress of claim 4, wherein the first hinge comprises a mechanism that locks the first folding arm and the second folding arm in the expanded position, the mechanism being movable to an actuated position to unlock the first folding arm and the second folding arm to permit movement into the collapsed position.

16. A mattress, comprising:

a pair of longitudinal bars;

a pair of width bars;

a pair of hinges coupling one of the longitudinal bars to the pair of width bars;

a pair of hinge mechanisms coupling the other of the longitudinal bars to the pair of width bars; and a cover configured to fit over the longitudinal bars and the width bars;

wherein the hinge mechanisms comprise a fixed member and a pivoting lock member joined by a hinge rod, the fixed member being immovably connected to the other of the longitudinal bars.

17. A mattress, comprising:

a pair of longitudinal bars;

a pair of width bars;

a pair of hinges coupling one of the longitudinal bars to the pair of width bars;

a pair of hinge mechanisms coupling the other of the longitudinal bars to the pair of width bars; and a cover configured to fit over the longitudinal bars and the width bars;

wherein the hinge mechanisms comprise a fixed hinge member and a pivoting lock member joined by a hinge rod, the fixed hinge member being connected to the other of the longitudinal bars; and wherein the pivoting lock member comprises a lock housing, a lock and a detent receiver, the lock housing being sized to fit between the pair of width bars.

18. The mattress of claim 17, wherein one end of the lock housing comprises hinge detents which are received in hinge holes defined in the pair of width bars and provide for hinged movement of the pivoting lock member relative to the pair of width bars.

19. The mattress of claim 17, wherein the lock housing further comprises a lock aperture that receives the lock.

20. The mattress of claim 17, wherein the lock includes a release, a mechanism and detents, the mechanism being biased to a locked position in which the detents extend our of the lock housing.

21. The mattress of claim 20, wherein actuation of the release causes the detents to retract from the lock housing.

22. The mattress of claim 20, wherein the detents are biased to a position wherein the detents extend out of the lock housing.

23. The mattress of claim 20, wherein when the release is actuated, the width bars are moveable to a collapsed position.

* * * * *